United States Patent [19]

Caprioli et al.

[11] Patent Number: 4,908,512

[45] Date of Patent: Mar. 13, 1990

[54] APPARATUS AND METHODS OF USE IN THE MASS ANALYSIS OF CHEMICAL SAMPLES

[75] Inventors: Richard M. Caprioli, Bellaire, Tex.; John S. Cottrell, Manchester, England

[73] Assignee: Kratos Analytical Limited, England

[21] Appl. No.: 767,819

[22] Filed: Aug. 21, 1985

[51] Int. Cl.[4] ..... H01J 49/04

[52] U.S. Cl. ..... 250/288; 250/281

[58] Field of Search ..... 250/288, 288 A, 281

[56] References Cited

U.S. PATENT DOCUMENTS 4,239,967 12/1980 Carr et al. ..... 250/288
4,267,457 5/1981 Nakagawa et al. ..... 250/288

FOREIGN PATENT DOCUMENTS 3028116 2/1982 Fed. Rep. of Germany ..... 250/288
125669 7/1980 Japan .

OTHER PUBLICATIONS

Leavitt, Van Nostrand's Scientific Encyclopedia, 1976, p. 422.
Caprioli et al, "Fast Atom Bombardment for Real--Time Analysis of Peptide Fragments . . . ", 46, pp. 419–422.
Smith & Caprioli, "Following Enzyme Catalysis . . . Mass Spectrometer", vol. 10, No. 2, pp. 98–102.
Caprioli et al., "Performance of a Fast Atom Bombardment Source . . . Mass Spectrometer", vol. 10, No. 2, pp. 94–97.
Bradley et al, "Peptide Sequencing Using the Combination of Edman . . . Mass Spectrometry", vol. 104, No. 4, pp. 1223–1230.
Hong et al, "Simultaneous Analysis of C-Terminal Amino Acid . . . Digestion", vol. 10, No. 8, 450–457.
Aimoto et al, "Amino Acid Sequence of a Heat-Stable Enterotoxin . . . Coli", 129, pp. 257–263.
Self & Parente, "The Combined Use of Enzymatic Hydrolysis . . . Peptide Sequencing", vol. 10, No. 2, pp. 78–82.
Brodbelt & Cooks, "An Exceedingly Simple Mass Spectrometer Interface . . . Analysis", 57, pp. 1155–1157.

*Primary Examiner*—Carolyn E. Fields
*Assistant Examiner*—Jack I. Berman
*Attorney, Agent, or Firm*—Leydig, Voit & Mayer

[57] ABSTRACT

A probe for supporting a sample in an ion source of a mass spectrometer comprises a target formed by a copper probe tip for a liquid sample in which the sample passes through a fine bore 18a of the tip on to the end surface of the tip where it is held as a droplet by surface tension. In order to replenish the droplet surface, capillary tubing leads from a syringe to the inlet end of the bore in the probe tip.

6 Claims, 1 Drawing Sheet

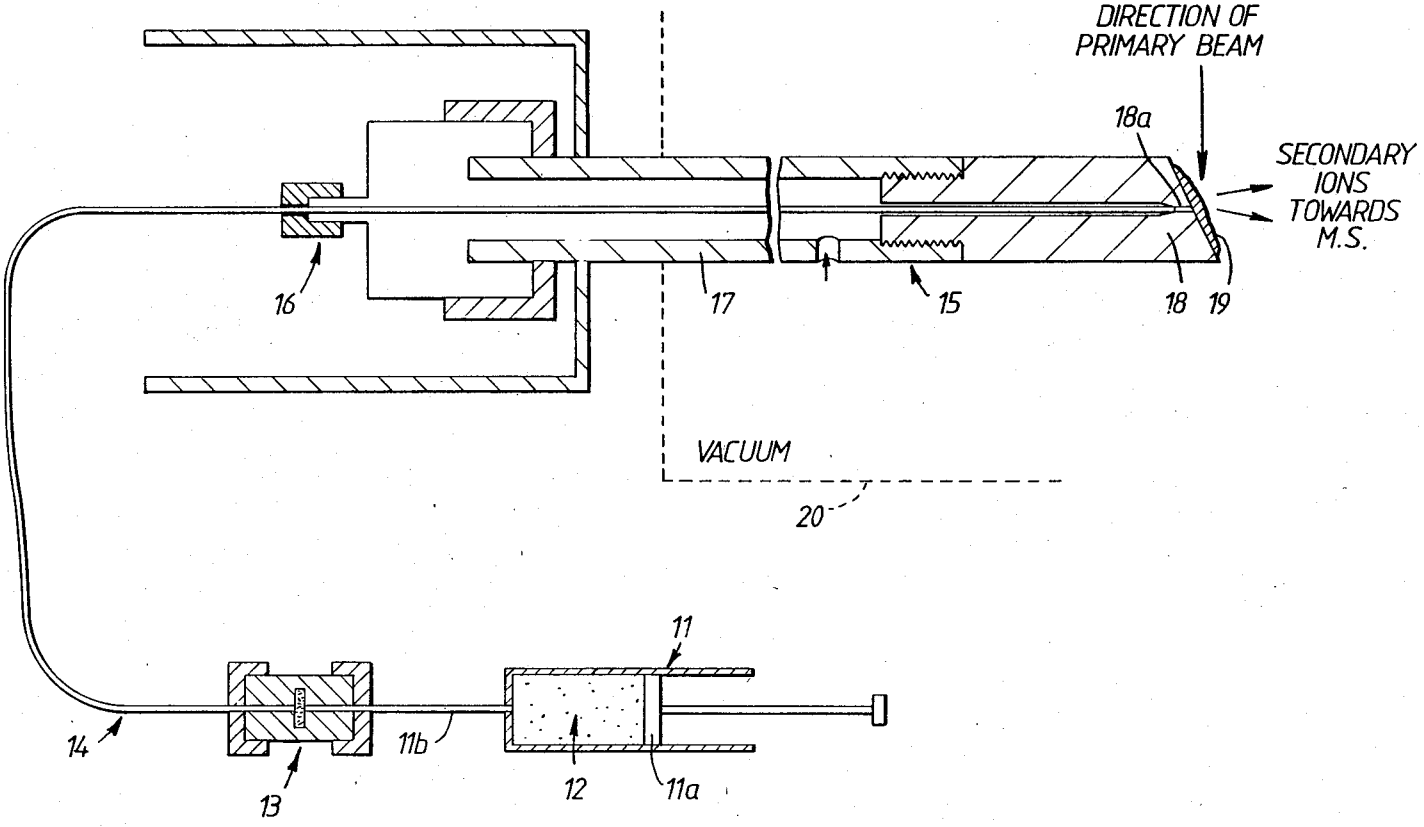
SECONDARY IONS TOWARDS M.S.
DIRECTION OF PRIMARY BEAM
19
18
18a
15
20
VACUUM
17
11
11a
12
11b
16
13
14

APPARATUS AND METHODS OF USE IN THE MASS ANALYSIS OF CHEMICAL SAMPLES

BACKGROUND TO THE INVENTION

This invention relates to mass spectrometry apparatus for use in the continuous analysis of a chemical sample, and methods of using such apparatus.

Methods of using mass spectrometers for the analysis of samples which do not change with time are well known, but in the use of mass spectrometers for analysis of the time profile of a chemical reaction, the problem arises of locating the sample in an ion source at the moment at which the reaction products are to be analysed.

It has been suggested (see Anal Chem 1985,57,1153–55) that the time profile of a chemical reaction can be monitored by passing aqueous samples through semipermeable silicon capillary tubing of which a loop is sealed within a high vacuum system, the inlet and outlet ends of the tubing being outside the vacuum system. Samples passing through the tubing wall enter an area which is connected by ducting to an ion source of a triple quadrupole mass spectrometer. However, this approach is only applicable to the analysis of volatile samples.

SUMMARY OF THE INVENTION

According to one aspect of the present invention there is provided mass spectrometry apparatus for use in the continuous analysis of a sample of which the composition may, or may not, change with time, which comprises a high vacuum system; means for depositing a supply of the sample on a surface located within the high vacuum system, the depositing means including a vessel for containing the sample and a duct extending between the vessel and the surface, the duct including a capillary tube, and means for forcing the sample from the vessel along the duct to the surface; means for ionising the deposited sample in situ on the surface; and means for mass analysing the ions so produced.

The present invention further provides apparatus for use in the continuous analysis of a sample of which the composition may, or may not, change with time, which apparatus comprises a mass spectrometer including a high vacuum analyser system and a sputtering ion source, a target carrier adapted to be connected to the high vacuum analyser system so that a surface of the target carrier subject to the high vacuum within the system can form a target for said ion source, and means effective during the operation of the apparatus for conducting a flow of liquid in which the sample is carried from a location, which is at a high pressure relative to that within said system, to the surface, which is subject to the high vacuum, the conducting means including a vessel for containing the sample and a duct extending between the vessel and the surface, the duct including a capillary tube, and means for forcing the sample from the vessel along the duct to the surface.

According to another aspect the present invention provides a method for the continuous analysis of a sample of which the composition may or may not change with time which comprises continuously forcing a supply of the sample from a vessel through a duct including a capillary tube to a surface located within a high vacuum system, ionising the sample in situ on the surface and mass analysing the ions so produced.

In particular the present invention provides a probe for insertion into a mass spectrometer which, in operation, permits a continuous replenishment of the sample at the target for irradiation. The mass spectrometer source in which the probe is located ionises the sample by F.A.B. (Fast Atom Bombardment), or any other sputtering technique.

BRIEF DESCRIPTION OF THE DRAWING

The invention will now be more particularly described by way of example only, with reference to the accompanying drawing which is a diagrammatic representation of apparatus in accordance with the present invention.

The apparatus illustrated in the drawing is designed to allow a sample under investigation to be introduced into the high vacuum system of a mass spectrometer.

DESCRIPTION OF THE PREFERRED EMBODIMENT

The apparatus comprises a gas-tight syringe 11 of suitable capacity (e.g. 50 or 100 microliters). This syringe is mounted on a mechanical actuator known as a "syringe pump" which moves a plunger **11*a* of the syringe at constant rate so as to provide a known flow of mixture 12 out of the needle 11*b* of the syringe. The mixture 12 would be typically 90 microliters degassed water, 10 microliters degassed glycerol, the sample under investigation (e.g. a peptide at a concentration of 1 microgram per microliter), an enzyme mixture, buffer salts and other ingredients dependent on the nature of the experiment. Coupling means 13 is used to connect the syringe needle to a length of fused quartz capillary tubing 14. This coupling means may conveniently include an in-line filter to remove particulate matter from the liquid flow which might otherwise block the capillary tubing 14. Capillary tubing 14 is typically a 1 meter length of 25 micrometer internal diameter fused quartz. The length and diameter are chosen such that only a few atmospheres of pressure are required to produce the desired flow rate. Capillary tubing 14 enters a probe assembly 15 through coupling means 16 which provides a vacuum tight seal. The probe assembly includes a hollow shaft 17 through which the capillary tubing 14 passes into a probe tip 18 through which a capillary bore 18*a* extends. The inner end of the bore of the probe tip 18 is a close fit to the capillary tubing 14 so as to provide good thermal contact between the probe tip 18 and the end of the capillary tubing 14. Preferably the probe tip is made of copper for good heat transfer. A vent 17*a* is provided in shaft 17 for efficient evacuation of the hollow probe shaft. In operation, a bead 19 of glycerol solution forms on the tip 18 at the outlet end of the bore 18*a* as a result of expulsion of solution through the tip 18, the liquid bead being retained by surface tension on the probe tip surface surrounding the bore outlet. The shape and angle of inclination of the end surface of probe tip 18** will depend on the geometry of the mass spectrometer ion source.

The probe tip is sealed into the high vacuum chamber 20 (shown by a dotted line) of the ion source of a mass spectrometer, with the outlet end of the probe tip bore located at a position on the path of a primary beam of radiation.

The principle of operation will now be described. Enzymatic reactions can only proceed in aqueous solution. On exposure to a vacuum, the water content of any solution will evaporate rapidly and the reaction will cease. This apparatus provides a means of introducing a continuous flow of reaction mixture into a mass spectrometer ion source without exposing the bulk of the mixture to the vacuum.

When the reaction mixture is pumped through a suitable capillary at a flow rate of about 1 microliter per minute, evaporation will not take place until the fluid emerges from the tip of the capillary. At this point, the water content of the mixture will evaporate rapidly, while the less volatile glycerol content will flow onto the probe tip end surface. Only a fraction of the glycerol will evaporate during the experiment; the area of the end surface of the probe tip (e.g. 30 square millimeters) is sufficient to support this volume of glycerol without it forming an unwieldy droplet. Approximately 54 microliters of water will evaporate into the source vacuum each hour. A typical mass spectrometer pumping system can cope with this flow rate and still maintain an adequate source vacuum.

Heat must be applied to the capillary tip if the continuous evaporation of water is not to result in the mixture freezing. To facilitate heat transfer, the probe tip is in good thermal contact with the capillary tubing. In our apparatus, the energy incident on the probe tip from the primary particle beam is sufficient to maintain it at room temperature. Under other circumstances some heating means, such as an electrical resistance heater, would be required.

A further advantage of using a fine quartz capillary is that the resistance of a 1 meter length is sufficient to prevent voltage breakdown between the probe tip and ground. In a magnetic mass spectrometer the probe tip may be at a potential of 10,000 V.

It may be advantageous to have control over the rate of chemical reaction within mixture 12. For example, the reaction could be inhibited during the loading of the syringe and during the insertion of the probe into the mass spectrometer source. Such control may be obtained through temperature regulation of mixture 12. Reduction of the temperature to 0° C. will inhibit the reaction whilst warming to body temperature will accelerate the reaction. Temperature regulation of the syringe and its contents could be provided by a water jacket. Temperature regulation of the capillary will not normally be necessary, although thermal insulation by means of heat insulating sleeving would be desirable.

A typical experimental procedure would be as follows: Syringe 11 is filled with a degassed solution of 90 microliters water, 10 microliters glycerol, Substance-P (a polypeptide) and a mixture of carboxypeptidase Y and carboxypeptidase P. The relative concentrations of the enzymes are such as to give complete hydrolysis of the polypeptide over the duration of the experiment (typically a few minutes per amino acid residue). The syringe is then coupled to the probe system as shown in the drawing.

The probe is introduced through a vacuum lock into a standard FAB source. The syringe pump is set to a flow rate of about 1 microliter per minute. A beam of primary particles or radiation is allowed to impinge upon the surface of the reaction mixture eluting on to the probe tip end surface. This primary beam would typically be xenon atoms, but could equally well be caesium ions, fission fragments, photons, etc., etc. The primary beam causes ions to be sputtered from the surface of the reaction mixure. These ions are then drawn into a mass spectrometer and mass analysed.

Observation of the mass spectrum of the reaction mixture will reveal the following features:

Initially, there will be a strong peak corresponding to the intact polypeptide molecule. If the mass spectrometer is transmitting positive ions this will be the protonated molecular ion $(M+H)^+$. In the case of Substance-P (H-Arginine-Proline-Lysine-Proline-Glutamine-Glutamine-Phenylalanine-Phenylalanine-Glycine-Leucine-Methionine-$NH_2$) the protonated molecular ion is observed at m/z 1349. As the polypeptide is digested by the enzyme mixture, amino acid residues are sequentially removed from the C terminus of the chain, thus we observe the appearance of new molecular ions corresponding to the loss of Met (yielding m/z 1218), loss of Leu (yielding m/z 1105), etc. Thus the mas difference between consecutive molecular ions identifies the amino acid residue removed from the chain, so yielding the amino acid sequence of the polypeptide. The only ambiguity in the sequence information provided by this technique is failure to distinguish between residues of the same molecular weight. Amongst the common amino acids there are only two examples of this: Glutamine and Lysine (both m/z 128) and the isomers Leucine and isoLeucine (both m/z 113).

An advantage of this technique is that the molecular ion intensities are obtained as a function of time. Some molecular ion peaks will be of relatively low intensity, possibly because the ion is produced by a cleavage which occurs particulary slowly resulting in a low instantaneous concentration of that species. Observation of the time dependant behaviour of the "parent" and "daughter" molecular ions will allow the time dependance of the "missing" molecular ion to be predicted. Since there will be only one or two possible mass values for the "missing" ion, this information will enable extremely weak molecular ions to be distinguished from interfering peaks which do not show the expected time dependence.

It will be appreciated that the application of this technique is not restricted to the C-terminus sequencing of peptides and proteins. Use of aminopeptidase enzymes permits peptides to be sequenced from the N-terminus. Alternatively, polysaccharides, oligonucleotides and other biopolymers may be sequenced using the appropriate reaction mixture.

The cell would also be ideal for the observation and measurement of enzyme kinetics and any experiment in which observation time would be limited by evaporation of a volatile solvent or matrix.

We claim:

1. Mass spectrometry apparatus for use in the continuous analysis of a sample of which the composition may, or may not, change with time, which comprises a high vacuum system; means for depositing a supply of the sample on a surface located within the high vacuum system, the depositing means including a vessel for containing the sample and a duct extending between the vessel and the surface, the duct including a capillary tube, and means for forcing the sample from the vessel along the duct to the surface; means for ionising the deposited sample in situ on the surface; and means for mass analysing the ions so produced.

2. Apparatus for use in the continuous analysis of a sample of which the composition may, or may not, change with time, which apparatus comprises a mass spectrometer including a high vacuum analyser system and a sputtering ion source, a target carrier adapted to be connected to the high vacuum analyser system so that a surface of the target carrier subject to the high vacuum within the system can form a target for said ion source, and means effective during the operation of the apparatus for conducting a flow of liquid in which the sample is carried from a location, which is at a high pressure relative to that within said system, to the said surface, which is subject to the high vacuum, the conducting means including a vessel for containing the sample and a duct extending between the vessel and the surface, the duct including a capillary tube, and means for forcing the sample from the vessel along the duct to the surface.

3. Apparatus according to claim 2 wherein the target carrier is formed by the tip of a probe having an external surface which surrounds an outlet orifice and forms the target surface, and said ducting, opening via said orifice on to said target surface so that the liquid containing the sample or reaction products can pass through the orifice on to said target surface.

4. Apparatus according to claim 3 wherein the probe tip is made of copper.

5. Apparatus according to claim 4 wherein the vessel and forcing means comprise a syringe containing a supply of said liquid, said syringe being connected to an inlet end of said capillary tubing.

6. A method for the continuous analysis of a sample of which the composition may or may not change with time which comprises continuously forcing a supply of the sample from a vessel through a duct including a capillary tube to a surface located within a high vacuum system, ionising the deposited sample in situ on the surface, and mass analysing the ions so produced.

* * * * *